United States Patent [19]

Kemper et al.

[11] 4,256,041

[45] Mar. 17, 1981

[54] DAMPING RAILWAY TRUCK FRICTION SHOE

[75] Inventors: James M. Kemper, Park Forest; Lynn K. Tilly, West Chicago, both of Ill.

[73] Assignee: AMSTED Industries Incorporated, Chicago, Ill.

[21] Appl. No.: 57,746

[22] Filed: Jul. 16, 1979

[51] Int. Cl.[3] ..... B61F 5/06; B61F 5/12; B61F 5/24

[52] U.S. Cl. ..... 105/197 DB; 267/9 A

[58] Field of Search ..... 105/197 D, 197 DB; 267/9 A

[56] References Cited

U.S. PATENT DOCUMENTS

| | | | |
|---|---|---|---|
| 2,953,995 | 9/1960 | Baker | 105/197 DB |
| 4,084,514 | 8/1978 | Bullock | 105/197 DB |
| 4,103,623 | 8/1978 | Radwill | 105/197 DB |
| 4,109,585 | 8/1978 | Brose | 105/197 DB |

*Primary Examiner*—Howard Beltran

*Attorney, Agent, or Firm*—Edward J. Brosius; Fred P. Kostka; John L. Schmitt

[57] ABSTRACT

An improved railway truck friction shoe is provided. The contact point of the shoe slope face with the bolster and the spring center line of the shoe are substantially coincident; the contact point is substantially equidistant from the top and bottom edges of the shoe column face. The convex sloped surface of the shoe has a reduced crown radius, and the vertical face of the shoe has an increased length. The shoe is designed to provide a more even distribution of contact pressures across its column face. This results in a longer wear life for the shoe by providing for more uniform wear.

2 Claims, 11 Drawing Figures

FIG. 1
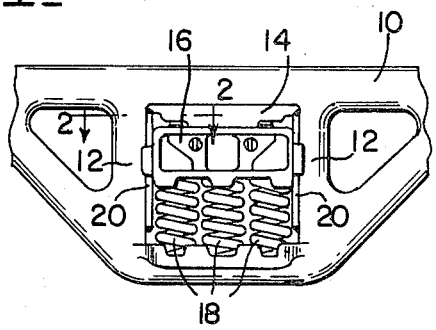
FIG. 2
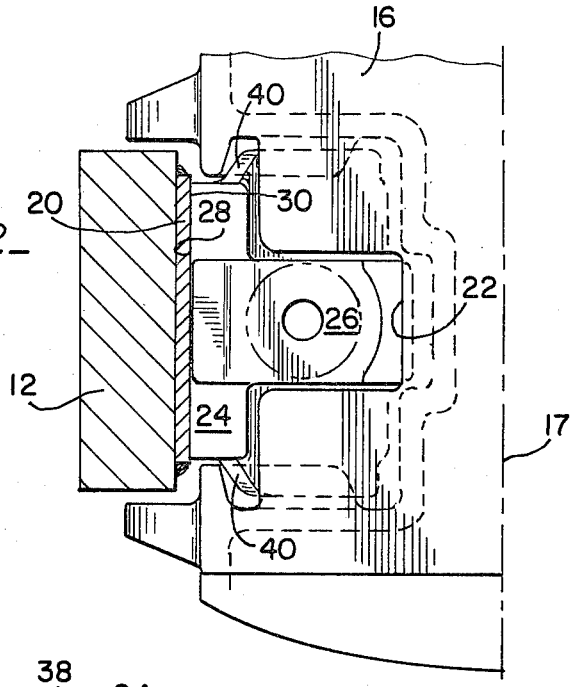
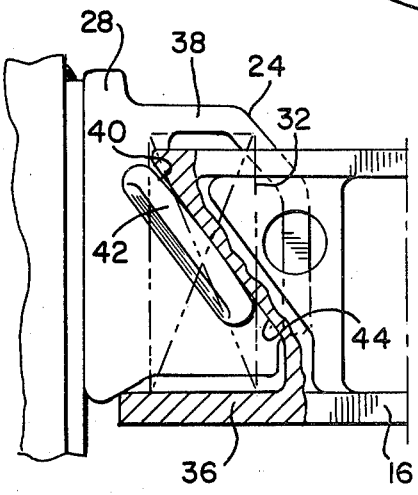
FIG. 3

DAMPING RAILWAY TRUCK FRICTION SHOE

BACKGROUND AND SUMMARY OF THE INVENTION

The present invention provides an improved railway truck friction shoe. More particularly, a friction shoe is provided which has improved vertical stability and extended wear life.

The type of railway car truck to which the present invention relates comprises, generally, spaced side frames, each of which has an opening arranged to support opposite ends of a bolster. Spring biased friction shoes are provided, having walls engageable with friction surfaces in the side frame opening. Two friction shoes engage each end of the side frame and bolster for controlling the oscillating movement of the bolster.

Typically, there are two major concerns in the design of railway truck friction shoes. One is that the stability of the friction shoe be maintained in order that excessive forces not be transmitted to the bolster or the side frame by the tilting and subsequent jamming of the shoe during its operation. Another is to extend the wear life of the friction shoe by evenly distributing the contact pressures across the side frame column face of the shoe.

U.S. Pat. No. 4,109,585, assigned to the assignee of the present invention, discloses an improved friction shoe wherein the friction shoe has extended wing surfaces that are inclined with respect to the guiding surfaces of the bolster. The present invention is concerned with further improvements and modifications to the friction shoe of this patent, and also to a friction shoe having a solid slope surface without wings.

It is an object of the present invention to provide an improved railway truck friction shoe with improved vertical stability and extended wear life.

The present invention provides an improved railway truck friction shoe wherein the contact point of the shoe with the bolster is substantially coincident with the bias spring center line, and, further, is substantially equidistant between the top and bottom edges of the column face of the shoe. The bias spring is located within the shoe as close to the side frame column as allowed by the required spring radius and wall thickness of the shoe. In an alternative embodiment, the spring engages a solid lower surface of the friction shoe which has a solid slope surface without wings. Further, the crown radius of the slope surface of the shoe or the wings of the shoe is reduced from the prior art known radii. Further, the length of the vertical or side frame column face of the shoe is increased. The combination of these features leads to an improved friction shoe exhibiting the features of improved vertical stability and extended wear life.

BRIEF DESCRIPTION OF THE DRAWINGS

In the drawings:

FIG. 1 is a fragmentary side elevational view of a railway car embodying the present invention;

FIG. 2 is a view, partly in section, taken along line 2—2 of FIG. 1;

FIG. 3 is a detailed side elevational view of the side frame column, friction shoe and bolster with part of the bolster broken away;

DESCRIPTION OF THE PREFERRED EMBODIMENT

Figure 5:
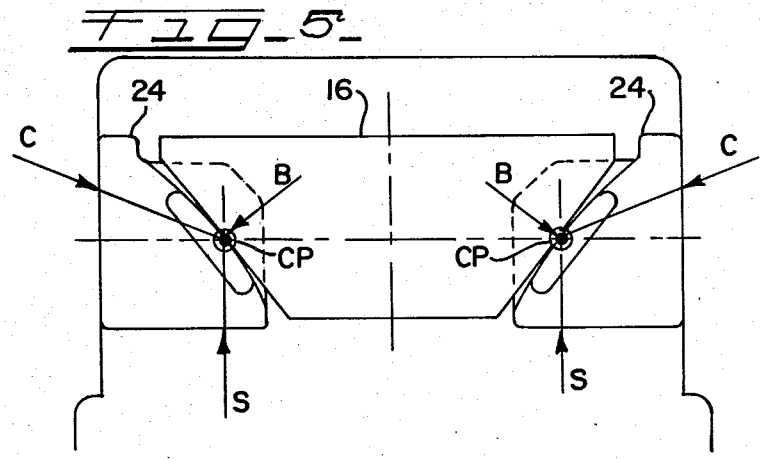
FIG. 5 is a diagrammatical view of a bolster end in upward level travel engaging two friction shoes.

Referring now to the drawings, in FIG. 1 there is shown a side frame 10 having a pair of columns 12 defining the sides of a bolster opening 14 formed in side frame 10. One end of a bolster 16 is resiliently supported in bolster opening 14 on springs 18. Friction plates 20 may be integral with or suitably mounted on side frame columns 12.

As shown in FIG. 2, bolster 16 is formed with pockets 22 on opposite sides of a longitudinal axis 17. The pockets each receive a friction shoe 24 adjacent to a respective side frame column 12.

Friction shoe 24 comprises a body portion 26 having a friction wall 28 which frictionally engages a friction surface 30 on the side frame column friction plate 20.

Figure 9:
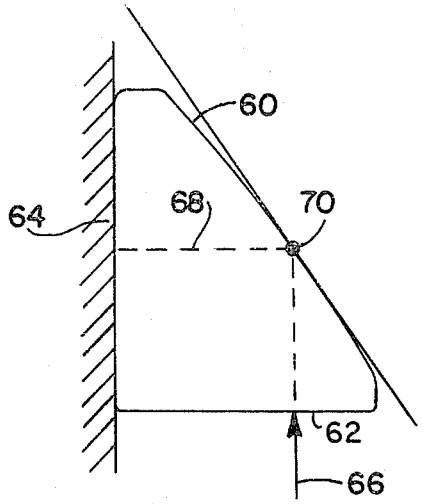
FIG. 9 is a side view of another embodiment of the friction shoe of the present invention.

Friction shoe 24 is urged into frictional engagement with plate 20 by a bias spring 32 shown diagrammatically in FIG. 3. Spring 32 is received in a central spring pocket (not shown) formed in friction shoe 24 and is compressed between a lower wall 36 of bolster 16 and an upper wall 38 of friction shoe 24. Spring 32 urges an upper surface 40 of sloped wings 42, which project outwardly from opposite sides of body portion 26 of friction shoe 24, into engagement with a guiding surface 44 of bolster 16. It will be understood that FIGS. 1–3 show one embodiment of the friction shoe of the present invention, i.e., having wings 42. Another embodiment of the friction shoe is shown in FIG. 9 and does not have wings, but rather has a slope surface on the side of the body opposite the column friction wall.

Referring now to FIGS. 4–7, it is seen that a friction shoe is acted on by three forces, the bias spring force S, the bolster slope force B at the contact point, and the side frame column force C. Although the column force C is distributed over the area of contact between the friction shoe face and the side frame column, it can be represented as a single vector which is the resultant of the normal force and the friction force which always opposes the direction of motion and is proportional in magnitude to the coefficient of friction between the friction shoe and the side frame column.

Figure 4:
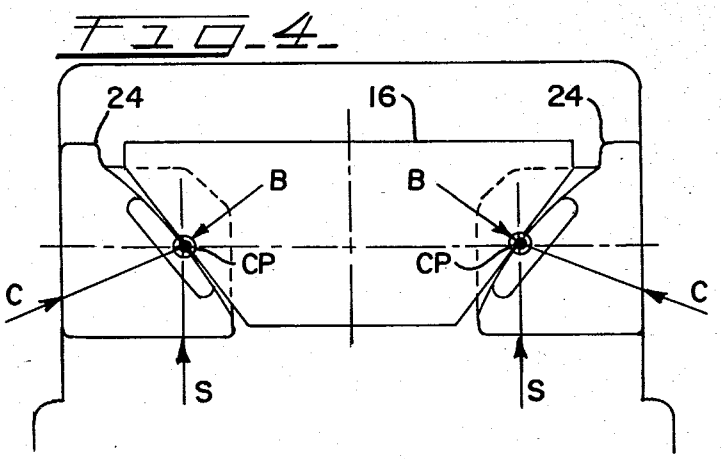
FIG. 4 is a diagrammatical view of a bolster end in downward level travel engaging two friction shoes.
Figure 7:
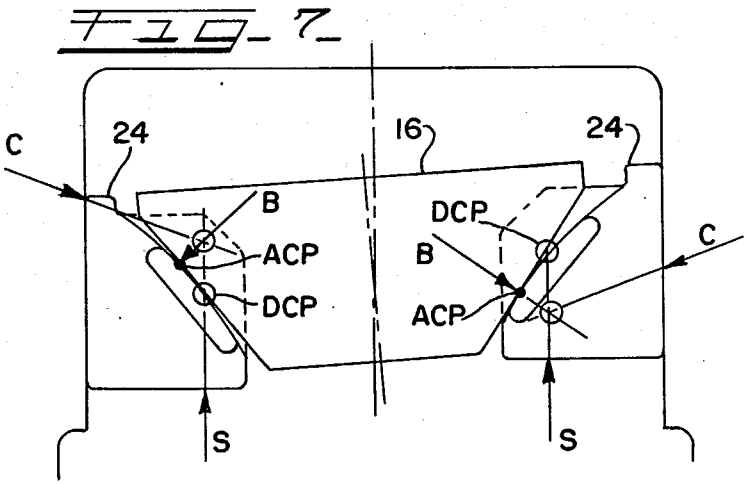
FIG. 7 is a diagrammatical view of a bolster end in upward tilted travel engaging two friction shoes.
Figure 6:
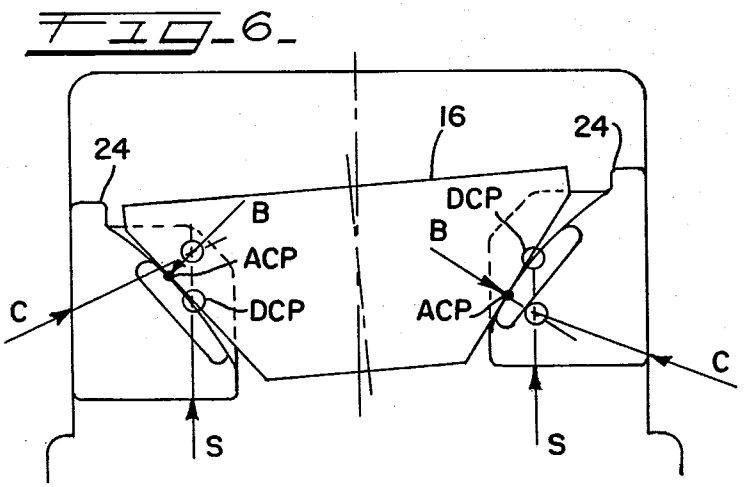
FIG. 6 is a diagrammatical view of a bolster end in downward tilted travel engaging two friction shoes.

Principles of mechanics dictate that in order for the friction shoe to be in equilibrium as a free body, the lines of action of the force vectors must intersect at a single point. In FIG. 4, where downward level bolster travel is depicted and FIG. 5, where upward level bolster travel is depicted, the forces intersect at the nominal design contact point, CP. However, when the bolster tilts relative to the side frame, as shown in FIG. 6, where downward tilted bolster travel is depicted, and FIG. 7, where upward tilted bolster travel is depicted, the contact point shifts from the design contact point, indicated at DCP, to the actual contact point, indicated at ACP.

For a given angle of bolster tilt, the distance that the contact point shifts is proportional to the radius of curvature on the shoe slope surface. In order for the forces acting on the shoe to intersect at a single point, the column force vector must move up or down on the shoe face. For the friction shoe to be stable, the intersection of the column force vector with the column must be within the boundaries of the shoe face. If it is not, the shoe will tilt. The present invention provides a friction shoe wherein the contact point is so located so as to minimize its shifting, so that for any direction of motion and with bolster tilt up to approximately one degree from the vertical, the column force vector will remain within the boundaries of the shoe column face and the shoe will not tilt. This avoids uneven wear on the bottom or top of the shoe column face, as frequently occurs with prior art friction shoes.

Figure 8:
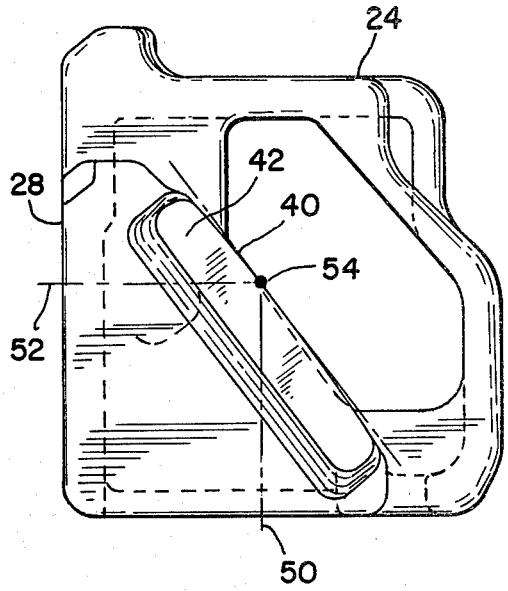
FIG. 8 is a detailed side elevational view of one embodiment of the friction shoe of the present invention.

One embodiment of a friction shoe having the design criteria of the present invention is shown in FIG. 8. Friction shoe 24 has a friction wall 28 for engaging a friction surface on a side frame (not shown). The center line of the bias spring is indicated at 50. This line intersects slope or upper wing surface 40 at a point 54 that also is the intersection of line 52, which is equidistant from the edges of column face 28, and slope surface 40. This intersection point 54 is the preferred contact point between slope surface 40 and guiding surface 44 of the bolster (not shown). The contact point 54 can properly be considered to be a point on the upper surface of the wings 42 which are convex with a radius of curvature of about 30–40 inches (76–100 cm). The preferred radius of curvature of about 30–40 inches is considerably less than that of known friction shoes which have a radius of about 60 inches (152 cm). The radius cannot be very much less than 30 inches (76 cm) due to contact stress limitations.

The center line 50 of the bias spring is preferably located as near as possible to column face 28, within design criteria allowing for a sufficient thickness of face 28 for strength and wear purposes and sufficient spring diameters. This acts to decrease the rotational moment acting to lift column face 28 from contact at its top or bottom with the side frame friction plate 20 (not shown) due to the tilted movement of bolster (not shown). Further, to decrease the possibility of either end of column face 28 from being lifted from contact with plate 20, the preferred length of column face 28 is increased from the standard 5.5–6 inches (14–15 cm) to 6–6.5 inches (15–16.5 cm).

Another embodiment of a friction shoe having the design criteria of the present invention is shown in FIG. 9. This type of friction shoe does not have wings, but rather has a solid convex slope face 60 which contacts the guiding surface of the bolster (not shown). The friction shoe is not adopted to receive a bias spring within a cavity, but rather has a solid lower surface 62 upon which the bias spring (not shown) acts upward against. The friction shoe also has a column face 64 for engaging a friction surface on a side frame (not shown). The center line of the bias spring force is indicated at 66. The centerline of column face 64 is indicated at 68. Lines 66 and 68 are seen to intersect at contact point 70 on convex slope face 60. The radius of curvature of slope face 60 is about 30–40 inches (76–100 cm). This radius is considerably less than the radius of known friction shoes which have a radius of about 60 inches (152 cm). The radius cannot, however, be very much less than 30 inches (76 cm) due to contact stress limitations.

The center line 66 of the bias spring is preferably located as near as possible to column face 64, within design criteria for strength and wear purposes and sufficient spring diameter. This acts to decrease the rotational moment acting to lift column face 64 from contact at its top and bottom with the side frame friction plate (not shown). Further, to decrease the possibility of either end of column face 64 from being lifted from contact, the preferred length of column face 64 is increased from the standard 5.5–6 inches (14–15 cm) to 6–6.5 inches (15–16.5 cm).

Figure 10:
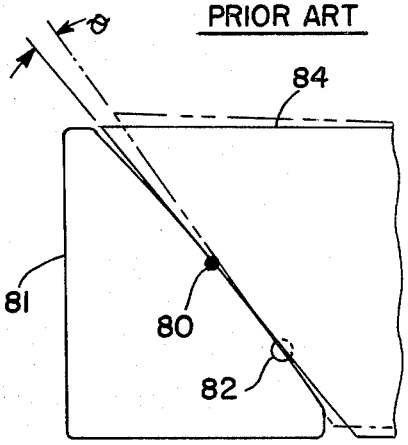
FIG. 10 PRIOR ART
FIG. 10 is a side view of a prior art friction shoe and bolster section, wherein the amount of contact point shift is indicated.
Figure 11:
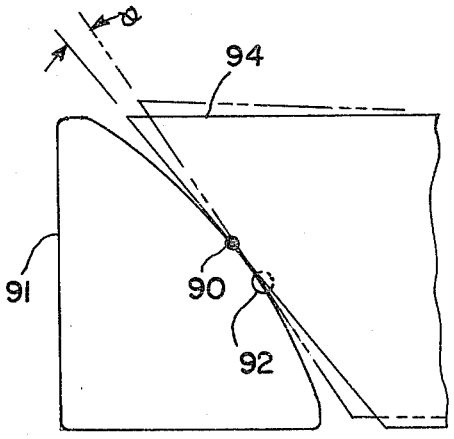
FIG. 11 is a side view of a friction shoe of the present invention and a bolster section, wherein the amount of contact point shift is indicated.

The improved friction shoe vertical stability due to a reduced radius of curvature for the shoe slope surface is depicted in FIGS. 10 and 11. A prior art, large radius of curvature friction shoe 81 is shown in FIG. 10. The design contact point is indicated at 80 on the convex slope surface. Upon the tilting of bolster 84 an amount equal to angle $\theta$, it can be seen that the contact point shifts to a new contact point 82. The large shift in the contact point due to the large radius of curvature of the slope surface would upset the equilibrium of the forces acting on the shoe causing the loss of flush contact along the column face. This causes uneven wear of the column face of the friction shoe.

One embodiment of the friction shoe of the present invention is shown in FIG. 11. Friction shoe 91 has a reduced radius of curvature of the convex slope surface from the prior art shoe shown in FIG. 10. The design contact point is indicated at 90 on the convex slope surface. Upon the tilting of bolster 94 an amount equal to angle $\theta$, which is identical to angle $\theta$ in FIG. 10, it can be seen that the contact point shifts to a new contact point 92. The reduced shift in the contact point from that seen in FIG. 10 is due to the reduced radius of curvature of the slope surface. The effect on the equilibrium of the forces acting on the shoe would accordingly be much less than the prior art, and the chance of causing the loss of flush contact along the column face is significantly reduced. The changes of uneven wear of the friction shoe are similarly reduced.

It should be understood that the present invention includes other embodiments not described here, and the scope of the present invention should be limited only by the following claims.

What is claimed is:

1. In a railway car truck comprising a side frame having substantially upright columns defining an opening, a bolster supported in said opening, friction surfaces provided on said upright columns, guiding surface means on said bolster, and friction shoe means disposed between said bolster and said column, said friction shoe means including a substantially vertical wall engageable with the friction surface on said upright columns, wherein the improvement comprises vertically convex wing surfaces on said friction shoe means engageable with the guiding surface on said bolster, and a vertical spring pocket and a spring within said pocket urging said wing surfaces into contact with the guiding surface of said bolster, said wing surfaces having a radius of curvature in a vertical plane, each of said wing surfaces engaging each guiding surface at a contact point, said contact point under normal level bolster operation being located substantially on the center line of said spring and substantially on the center line of said vertical wall, such that upon tilting of the bolster under operating conditions, contact is maintained between the bolster guiding surfaces and both shoe wing surfaces.

2. In a railway car truck comprising a side frame having substantially upright columns defining an opening, a bolster supported in said opening, friction surfaces provided on said upright columns, guiding surfaces on said bolster, and friction shoe means disposed between said bolster and said column, said friction shoe means including a substantially vertical wall engageable with the friction surfaces on said upright columns, wherein the improvement comprises a vertically convex slope surface on said friction shoe means engageable with the guiding surfaces on said bolster, and vertical springs engaging the bottom surface of said friction shoe means urging said slope surface into contact with the guiding surfaces of said bolster, said slope surfaces having a radius of curvature in a vertical plane, said slope surfaces engaging said guiding surfaces at a contact point, said contact point under normal level bolster operation being located substantially on the center line of said spring and substantially on the center line of said vertical wall, such that under tilted bolster operations the contact point is shifted while contact is maintained between the bolster guiding surfaces and both friction shoe slope surfaces.

* * * * *